United States Patent [19]

Laakso et al.

[11] 4,061,193

[45] Dec. 6, 1977

[54] METHOD AND APPARATUS FOR DIGESTING CELLULOSE MATERIAL WITHOUT SCREENING DIGESTING LIQUID WITHDRAWN THROUGH THE DIGESTER TOP

[75] Inventors: Oliver A. Laakso; Michael I. Sherman, both of Glens Falls, N.Y.

[73] Assignee: Kamyr, Inc., Glens Falls, N.Y.

[21] Appl. No.: 659,638

[22] Filed: Feb. 20, 1976

Related U.S. Application Data

[63] Continuation-in-part of Ser. No. 613,554, Sept. 15, 1975, abandoned.

[51] Int. Cl.[2] ..... D21C 3/24; D21C 7/14; D21C 1/00

[52] U.S. Cl. ..... 162/19; 162/37; 162/40; 162/237; 162/243; 162/248; 162/249; 162/251

[58] Field of Search ..... 210/205, 208, 219, 220 R; 23/270 R, 290.5; 162/17, 19, 237, 243, 251, 239, 246, 248, 37, 40, 249, 60

[56] References Cited

U.S. PATENT DOCUMENTS

| | | | |
|---|---|---|---|
| 1,914,073 | 6/1933 | Brobeck | 162/251 |
| 2,730,888 | 1/1956 | Seely et al. | 68/181 R |
| 3,007,839 | 11/1961 | Richter | 162/17 |
| 3,200,032 | 8/1965 | Richter et al. | 162/19 |
| 3,298,899 | 1/1967 | Laakso | 162/237 |
| 3,425,098 | 2/1969 | Laakso | 162/19 |
| 3,429,773 | 2/1969 | Richter | 162/237 |
| 3,434,920 | 3/1969 | Green | 162/246 |
| 3,441,475 | 4/1969 | Tomlinson | 162/237 |
| 3,530,034 | 9/1970 | Erickson | 162/19 |
| 3,711,367 | 1/1973 | Christenson | 162/251 |

FOREIGN PATENT DOCUMENTS

| | | | |
|---|---|---|---|
| 530,135 | 9/1956 | Canada | 162/248 |
| 2,361,627 | 6/1974 | Germany | 162/237 |

*Primary Examiner*—S. Leon Bashore
*Assistant Examiner*—Steve Alvo
*Attorney, Agent, or Firm*—Cushman, Darby & Cushman

[57] ABSTRACT

Apparatus and method for digestion of cellulose material in a continuous digestion process, that do not require screens in the outlet of the digesting zone. Cellulose chips and digesting liquid at relatively low temperature are introduced into a relatively long and thin cylindrical impregnation vessel, having a first diameter. The chips from the impregnation vessel pass into a digestion vessel having a second diameter substantially greater than the first diameter, the outlet for the impregnation zone into the digestion vessel being disposed well into the digestion vessel and below an outlet(s) disposed in the top of the digestion vessel, and form a chips column in the digestion vessel. Digesting liquid at a relatively high temperature is introduced into contact with the chips, at a point a significant distance below the impregnation vessel outlet, and the quantity of digesting liquid being introduced and the first and second diameters are so arranged that the velocity of liquid flowing to the digestion vessel top outlet is substantially less than the velocity of liquid that would entrain significant numbers of particles therein, whereby a clarifying section is provided between the chips column and digestion vessel outlet so that the need for screens at the outlet is eliminated. A pair of vertically arranged screens which are alternately connected to a suction source may be provided in the clarifying section between the top of the chips column and the outlet to remove any particles that might be entrained in the liquid therein from the liquid.

7 Claims, 1 Drawing Figure

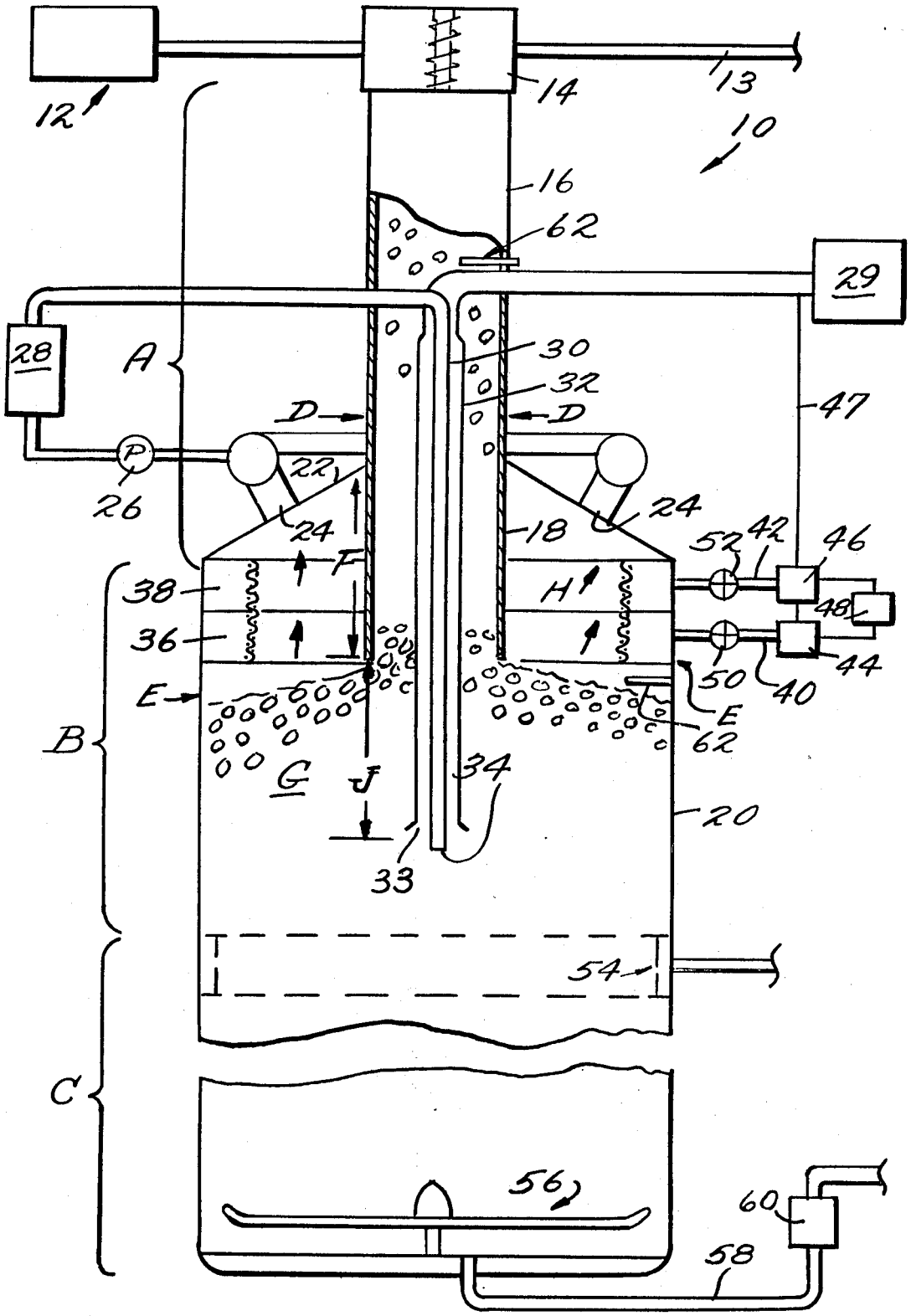
12
14
13
10
16
62
29
28
A
30
32
47
D
D
22
26
24
24
18
52
42
46
38
F
H
48
36
44
50
40
E
E
62
B
G
J
34
20
33
54
C
56
60
58

METHOD AND APPARATUS FOR DIGESTING CELLULOSE MATERIAL WITHOUT SCREENING DIGESTING LIQUID WITHDRAWN THROUGH THE DIGESTER TOP

CROSS-REFERENCE TO RELATED APPLICATION

This application is a continuation-in-part of application Ser. No. 613,554 filed Sept. 15, 1975 and now abandoned.

BACKGROUND AND SUMMARY OF THE INVENTION

The invention relates to a method and apparatus for continuous cellulose digestion that does not require the use of screens in the digesting zone. In present installations, clogged screens in the digesting zone are a major cause of downtime for continuous digestors. Liquid usually passes through the screens under high pressure which has a tendency to cause cellulose particles to adhere to the screen faces, building up and causing complete blockage of liquid flow through the screens. If such blockage is not eliminated, then uneven treatment of the cellulose material may result. The raw product that is treated in modern day digestors often contains a large amount of leaves, bark, etc., and therefore has a great tendency to clog conventional digesting zone screens.

According to the present invention, the screens of prior art digestors — such as shown in U.S. Pat. Nos. 3,007,839, 3,200,032, and 3,298,899 — are eliminated, separation of liquid and cellulose fiber chips taking place in a clarifying portion at the top of the digestor, and thus there obviously are no hangups due to screen clogging, while effective liquid-chips separation is effected. The cylindrical impregnation zone vessel of the continuous digestor according to the present invention is of smaller diameter and relatively longer than conventional continuous digestor impregnation zones, and extends downwardly into the digesting zone to a point well below the liquid outlets at the top of the digesting zone. The cylindrical casing for the digesting zone is of significantly larger diameter than the diameter of the impregnation zone (the area of the impregnation zone being approximately $\frac{1}{4}$ - $\frac{1}{8}$ the area of the digesting zone), and is liquid filled and has digesting liquid outlets disposed at the top thereof, above the lower end of the impregnation zone vessel. The inlet for the digesting liquor must be sufficiently below the end of the impregnation zone casing so that there is adequate, even distribution of the heated liquid through the chips column, a countercurrent flow to the downward movement of the chips being established. This normally requires the inlet for the digesting liquor be located a distance below the impregnation zone casing of at least the radius of the digesting vessel. The chips column effectively acts as a heat distributor.

When the chips move downwardly from the impregnation zone into the digesting zone, because of the increase in diameter of the container, they tend to flow generally outwardly and downwardly, and establish a generally conical surface top over the area of the digesting zone. This surface acts to separate the liquid flowing upwardly therethrough at slow speed (approximately 5 ft./min., whereas a velocity of approximately 50 ft./min. would be necessary to entrain the chips particles with the liquid for upward flow therewith) from the chips, and thus forms a clarifying zone in the upper portion of the digestor zone above the bottommost portion of the impregnation zone vessel. Since the chips are already separated from the liquid by the time the liquid reaches the outlets, there is no need to provide screens at the outlets at the top of the digesting zone.

In order to further ensure that no chips flow through the liquid outlets at the top of the digesting zone, a pair of screened portions connected to suction means are provided below the liquid outlet, but above the chip column, never being in contact therewith. The suction means for each of the screened portions are alternately actuated, to suck particles adjacent thereto into contact with the screen face, and then to release the suction to allow the particles to fall downwardly back into the chips column.

In addition to providing the advantage of no screens, the present invention also results in lower compaction and a freer movement of the column, which in turn allow superior counter-current washing in the washing zone, and assists in cleaning the screens therein. Also, although screenless washing, such as disclosed in U.S. Patent application Ser. No. 423,812 of Richter et al., filed Dec. 11, 1973, now abandoned, in a separate and distinct zone may be utilized, there is really to need therefor, washing in the continuous digestor vessel itself being practical with reduced chances of the washing zone screens becoming clogged.

It is the primary object of the present invention to provide for cellulose digestion without utilizing screens for digesting liquor recirculation. This and other objects of the invention will become clear from an inspection of the detailed description of the invention, and from the appended claims.

BRIEF DESCRIPTION OF THE DRAWINGS

The drawing is a schematic view of an exemplary continuous digestor according to the present invention providing a screenless digesting zone.

DETAILED DESCRIPTION OF THE INVENTION

A continuous digestor and associated assembly according to the present invention are shown generally at 10 in the drawing. The assembly 10 includes a conventional steaming vessel 12 or the like from which wood chips or like cellulose material is fed to the digestor inlet or charging means 14, which may include a helical feed screw therein. The charging means 14 feeds cellulose material entrained in digesting liquid from feed line 13 or the like into a first zone A of the digestor, the impregnation zone, wherein the cellulose material is impregnated with digesting liquid at a relatively low temperature. The impregnation zone A is defined by a cylindrical vessel 16 having a diameter D. It is preferred that the vessel 16 taper slightly outwardly in the downward direction, for instance being 9 feet in diameter at the top, and 9 feet 6 inches at the bottom, which tapering facilitates the downward movement of the chips. The diameter D of the impregnation zone vessel 16 is smaller than for conventional continuous digestor impregnation zones, but is also longer. The vessel 16 has a lower portion 18 thereof which extends downwardly into the digesting zone B a distance F, the bottom of the lower portion 18 being well below the liquid outlets 24 in the digesting zone B, as will be hereinafter explained.

The digesting zone B and subsequent treatment zone C are defined by a vessel 20 having a diameter E significantly greater than the diameter D of the impregnation zone vessel 16. Preferably, the diameters D and E are chosen so that the cross-sectional area of the vessel 20 is 3–4 times greater than the cross-sectional area of the vessel 16. The vessel 20 has a top surface 22 thereof in which one or more outlets 24 for the hot digesting liquid are disposed. Spent digesting liquid which passes through the outlets 24 under the force of the pressure in vessel 20 may be circulated by circulating pump 26 through a heater 28 or the like and otherwise recharged, and recirculated back to the digestor for further treatment of other cellulose material. Inlets for the hot digesting liquid may be provided by any suitable structure, such as conventional concentric inlet pipes 30, 32, leading from a source 29 of digesting liquid. Regenerated digesting liquid withdrawn through outlets 24 may be introduced through inlet pipes 30, 32.

It has been found that in order for there to be proper heat distribution and digesting liquor distribution in the chips column, the digesting liquor introduced by pipes 30, 32 or the like must be introduced a distance J below the bottommost portion of vessel 16, the distance J being a significant distance at least equal to ½ E (that is at least equal to the radius of vessel 20). As an optimum, it has been found that if E is 15 ft., J should be about 12 ft., or about 80% of E. The introduction of the digesting liquid at points 33, 34 of pipes 30, 32 also insures that there will be no "short-circuiting" of the digesting liquid — that is by-passing the chips column G and going directly into the outlets 24; a counter-current flow between the digesting liquid and the chips column is produced.

As cellulose material chips and the like move downwardly through the impregnation zone A into the digesting zone B, they form a chips column G being relatively high in the center, the point of entrance of vessel 16 into zone B, and tapering downwardly therefrom on all sides. The liquid may pass through the top surface of the chips column G, while the chips are retained in the column G. The area H in vessel 20 above the column G — having generally the same length F as the vessel 16 portion 18 — acts as a clarifier or stilling well. The diameters D and E and the amount of digesting liquid introduced into vessel 20 are so gauged that the velocity of liquid flowing through portions of chips column G toward outlets 24 is approximately 5 ft./min., while the velocity that is necessary to entrain the chips particles therein and move them upwardly therewith is approximately 50 ft./min. This low velocity also ensures even chips treatment. Therefore, very few chips will be moved with the liquid upwardly past the upper surface of column G to area H, and therefore there is no need to provide screens on outlets 24.

In order to further ensure that any particles that are entrained with liquid flowing through chips column G toward outlets 24 are removed before entering outlets 24, according to the present invention a pair of screens 36, 38 are provided on the vertical side walls of vessel 20 adjacent the top surface 22 of vessel 20. Each screen 36, 38 is vertically separated from the other, and connected to a different suction line, 40, 42. Line 40 interconnects screen 36 and suction source 44, while line 42 interconnects screen 38 and suction source 46. Suction is alternately applied by controlling sources 44, 46 with a suitable master control means 48. When suction is applied to screen 36, no suction is applied to screen 38, and vice versa. When suction is applied to either of the screens 36, 38, some liquid is withdrawn therethrough, and particles entrained with the liquid withdrawn therethrough are pulled to the surface of the screen. Then when the suction is no longer applied to the screen the particles against the screen surface will fall downwardly back into the chips column G. Thus, neither of the screens 36, 38 will become clogged since suction is applied only intermittently thereto, and only for a short period of time. Also, the screens are not in contact with the chips column G, therefore the tendency for the screens to become clogged is even more greatly reduced.

While control of the suction through screens 36, 38 has been shown in the drawing to be by controlling a pair of sources 44, 46, such control can be affected by other means. For instance, a single suction source may be provided, and valves 50, 52 in lines 40, 42 alternately controlled to hook up the single suction source with screens 36, 38. Liquid withdrawn through the screens 36, 38 may of course be recirculated back to the inlet pipes 30, 32, as through line 47, and of course an accessory heating means or the like may be provided for regenerating the digesting liquid before reintroduction.

During treatment in the continuous digestor according to the present invention, individual particles in the column G move downwardly through digesting zone B of the vessel 20, and eventually into other treatment zones C (for washing, further digesting, etc.), and eventually will be drawn out through conventional outlet 58 in vessel 20, with conventional scraper 56 facilitating outward movement of the treated chips. Screens 54 may be provided in washing zone C if desired (of course the points 33, 34 of pipes 30, 32 must be located significantly above the screens 54 so that there is no chance of digesting liquid flowing from the pipes through the screens 54), and there are reduced chances of the screens 54 clogging since according to the present invention lower compaction and freer movement of the column G result, with improved counter-current washing in zone C, and the freer moving, less compact column G having a tendency to scrape the screens 54 clean during downward movement of the chips in column G. Washing or other treatments in zone C are conventional such as shown in U.S. Pat. No. 3,298,899. After withdrawal of the treated chips from the vessel 20, they may be passed through blow tank 60 or the like, or otherwise conventionally treated. Additionally, a number of level detectors 62 for indicating compaction of the chips column may be provided if desired.

Operation of the apparatus according to the present invention is as follows: Cellulose material, such as wood chips and the like, is introduced into the continuous digestor charging means 14 from steaming vessel 12, and a first quantity of conventional digesting liquid at a relatively low temperature is introduced through line 13 into charging means 14. The chips-liquid mixture moves through impregnation zone A, which is defined by a vessel 16 which has a diameter D, is relatively smaller than the diameter of conventional digestor impregnation zone sections, and which extends a distance F into the vessel 20 containing digesting zone B and further treatment zones C. Digesting liquid is introduced into the chips at inlets 33, 34 or the like, a distance J below the bottom vessel 16, and flows upwardly through portions of the chips column G into outlets 24 at the top of the vessel 20. The quantity and velocity of liquid introduced into vessel 20 and the relative diameters D, E of the vessels 16, 18 are adjusted so that the liquid moves upwardly with a sufficiently small velocity that very few chips are entrained therewith, the upper portion H of the vessel 20 acting as a clarifier or stilling well, and therefore no screens for outlets 24 are required. To remove any chips particles that might be entrained with liquid flowing toward outlets 24 in portion H above chips column G, a pair of alternately operated screens 36, 38 are provided above the surface of chips column G but below the outlets 24. After treatment in the digesting zone B, the individual chips in the chips column G move downwardly through the continuous digestor vessel 20, and are further treated according to conventional practice, the treated chips being finally withdrawn through chips outlet 58 at the bottom of vessel 20.

While the invention has been herein shown and described in what is presently conceived to be the most practical and preferred embodiment of the invention, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Apparatus for continuous digestion of cellulose material chips comprising a cylindrical vertically disposed impregnation vessel having a first given diameter, an inlet at the top thereof, and an outlet at the bottom thereof, means for introducing cellulose material chips and digesting liquid at relatively low temperature into said impregnation vessel inlet, a cylindrical vertically disposed liquid-filled digesting vessel having a second given diameter, greater than said first given diameter, a top, and having a digesting zone and other treatment zones therein, the area of said impregnation vessel outlet being approximately $\frac{1}{4}$–$\frac{1}{3}$ as great as the area of said digesting vessel, said impregnation vessel extending through the top of said digesting vessel, concentric therewith, a predetermined distance so that said impregnation vessel outlet is disposed a significant distance below the top of said digesting vessel, a chips column formed in said digesting vessel below the outlet from said impregnation vessel by chips entering said digesting vessel from said impregnation vessel outlet, a liquid outlet formed in the top of said digesting vessel, a substantial distance above said impregnation vessel outlet and above said chips column, means for introducing digesting liquid at relatively high temperature into said cellulose material chips column at a point a distance J below said impregnation vessel outlet great enough so that even distribution of liquid through said chips column results and so that short-circuiting of liquid to said liquid outlet formed in the top of said digesting vessel is prevented, said distance J being equal to or greater than $\frac{1}{2}$ said second given diameter, the quantity of liquid introduced into said digesting vessel and the first and second diameters being so dimensioned that the velocity of liquid flowing through said chips column to said digesting vessel outlet is substantially less than the velocity of liquid that entrains a significant amount of cellulose material, so that substantially no cellulose particles pass upwardly from said chips column to said liquid outlet, means for withdrawing treated cellulose material from the bottom of said digesting vessel at a given rate so that the chips column is maintained at substantially the same level while individual particles thereof move downwardly through said vessel, and means for removing any particles entrained in liquid passing from said chips column to said digesting vessel top outlet from said liquid, said means comprising a pair of vertically arranged screens, one atop the other, disposed on generally vertical side walls of said digesting vessel above said chips column and below said liquid outlet, and means for alternately applying suction to one of said screens and not the other to withdraw liquid from said digesting zone while particles are screened out.

2. Apparatus as recited in claim 1 further comprising a recirculating pump and a heater operatively connecting said digesting vessel top outlet and said means for introducing digesting liquid into said cellulose material chips column at said point below said impregnation vessel outlet.

3. Apparatus as recited in claim 1 wherein said means for introducing digesting liquid into said material chips column at said point below said impregnation vessel outlet comprises an inlet pipe concentric with said impregnation vessel and extending downwardly therethrough adjacent said impregnation vessel outlet.

4. Apparatus as recited in claim 1 wherein said means for withdrawing treated cellulose material from the bottom of said digesting vessel includes an outlet at the bottom of said vessel, and a scraper disposed above said outlet.

5. A method for continuously digesting cellulose material in a vertical digester having an impregnation zone defined by an impregnation vessel having a first diameter, and a digesting zone and subsequent treatment zones defined by a digesting vessel having a second diameter substantially larger than said first diameter, said impregnation vessel extending downwardly into said digesting vessel a significant distance, and an outlet being disposed in the top of said digesting vessel above the outlet of said impregnation vessel into said digesting vessel, and the area of said impregnation vessel outlet being approximately $\frac{1}{4}$–$\frac{1}{3}$ as great as the area of said digesting vessel, said method comprising the steps of introducing cellulose material and digesting liquid at relatively low temperature into said impregnation vessel at the top thereof, said material and liquid passing downwardly through said impregnation vessel toward said digesting vessel.

introducing chips-liquid mixture from said impregnation vessel into said digesting vessel through said impregnation vessel outlet so that the chips form a chips column in said digesting vessel, the highest point of which is at said impregnation vessel outlet, introducing digesting liquid at a relatively high temperature into contact with chips at a point a distance J below said impregnation vessel outlet great enough so that even distribution of liquid through said chips column results and so that short-circuiting of liquid to said liquid outlet formed in the top of said digesting vessel is prevented, said distance J being equal to or greater than $\frac{1}{2}$ said second given diameter, withdrawing liquid flowing through said chips column from said digesting vessel through said liquid outlet disposed at the top of said digesting vessel without straining at said liquid outlet, the quantity of liquid introduced into said digesting vessel and the first and second diameters being so dimensioned that the velocity of liquid flowing through said chips column to said digesting vessel outlet is substantially less than the velocity of liquid that entrains a significant amount of cellulose material in its flow so that substantially no cellulose particles pass upwardly from said chips column to said liquid outlet, withdrawing treated cellulose material from the bottom of said digesting vessel at a given rate so that the chips column is maintained at substantially the same level while individual particles thereof move downwardly through said vessel, and removing any particles that are entrained in liquid above said chips column flowing from said chips column to said digesting vessel top outlet from said liquid by alternatively applying suction to one of two screens disposed on generally vertical digesting vessel walls between the chips column top and said liquid outlet while not applying it to the other screen.

6. A method as recited in claim 5 comprising the further step of washing said chips in said column after they pass through the digesting zone in said digesting vessel to a washing zone.

7. A method as recited in claim 5 comprising the further steps of recirculating liquid withdrawn through said liquid outlet in said digesting vessel top back to said point below said impregnation vessel outlet after heating of said liquid.

* * * * *